US007162751B2

(12) United States Patent
Mundt

(10) Patent No.: US 7,162,751 B2
(45) Date of Patent: Jan. 16, 2007

(54) VENTILATED TOILET SYSTEM

(76) Inventor: Fred S. Mundt, 9810 NE. 133rd Pl., Kirkland, WA (US) 98034

( * ) Notice: Subject to any disclaimer, the term of this patent is extended or adjusted under 35 U.S.C. 154(b) by 0 days.

(21) Appl. No.: 11/005,232

(22) Filed: Dec. 7, 2004

(65) Prior Publication Data

US 2005/0081285 A1 Apr. 21, 2005

(51) Int. Cl.
*E03D 9/032* (2006.01)

(52) U.S. Cl. ..... 4/349; 4/213; 4/216; 55/319

(58) Field of Classification Search ..... 4/213, 4/216, 349, 209 R, 209 FF; 55/319
See application file for complete search history.

(56) References Cited

U.S. PATENT DOCUMENTS

| | | | | | |
|---|---|---|---|---|---|
| 1,342,716 | A | * | 6/1920 | Johnston | 4/213 |
| 2,778,033 | A | | 1/1957 | Majauskas | 4/213 |
| 3,192,539 | A | | 7/1965 | Martz | 4/218 |
| 3,681,790 | A | | 8/1972 | Dooley | 4/216 |
| 4,017,916 | A | * | 4/1977 | Pearson | 4/213 |
| 4,153,956 | A | * | 5/1979 | Fischer et al. | 4/213 |
| 4,165,544 | A | | 8/1979 | Barry | 4/213 |
| 4,232,406 | A | | 11/1980 | Beeghly et al. | 4/213 |
| 5,029,346 | A | | 7/1991 | Fernald, Sr. | 4/213 |
| 5,054,130 | A | * | 10/1991 | Wilson | 4/213 |
| 5,054,131 | A | | 10/1991 | Sim | 4/216 |
| 5,575,019 | A | * | 11/1996 | Kijewski | 4/209 R |
| 5,839,127 | A | | 11/1998 | Curiel | 4/216 |
| 5,906,009 | A | | 5/1999 | Sakar | 4/216 |
| 5,991,933 | A | | 11/1999 | Schaffer | 4/216 |
| 6,219,853 | B1 | | 4/2001 | Johnson | 4/216 |
| 2002/0194670 | A1 | | 12/2002 | Hashemi | 4/213 |

FOREIGN PATENT DOCUMENTS

| | | |
|---|---|---|
| DE | 4321704 | 4/1994 |
| DE | 19903952 | 10/1999 |
| GB | 2319268 | 5/1996 |
| WO | WO 95/30802 | 11/1995 |

* cited by examiner

*Primary Examiner*—Robert M. Fetsuga
(74) *Attorney, Agent, or Firm*—Richard C. Litman

(57) ABSTRACT

A ventilated toilet system with a toilet bowl, a toilet tank and a ventilation system. The ventilated toilet system has a vacuum system motor to expel odors from the ventilated toilet system via odor exhaust piping of varying widths, with an impeller and a housing for the vacuum system motor, that include a time delay contact relay, a flush lever button switch, a ground fault circuit interrupter with an on/off switch, a float switch and a contact relay.

2 Claims, 9 Drawing Sheets

VENTILATED TOILET SYSTEM

BACKGROUND OF THE INVENTION

1. Field of the Invention

The present invention relates to a ventilated toilet system that removes and expels odors from a toilet bowl.

2. Description of the Related Art

Ventilation systems for toilet systems are known and present in the marketplace. These ventilation systems generally involve the use of an exhaust fan, an impeller or vacuum motor to expel malodorous fumes from a standard toilet system. These ventilation systems can be included as part of a new toilet system or can be a retrofit ventilation system for a currently existing toilet system.

The ventilation systems for toilet systems can incorporate some interesting and fairly sophisticated technologies. These include tying solenoid valves or motion detectors into the activation of the ventilation system. The ventilation systems can also be automatically initiated upon use of a toilet seat or an outside switch. Clever mechanics and engineering helps obtain better performance from provided ventilation systems as well. These ventilation systems can expel odors into an exterior atmosphere or environment or into a sewage line. Many of these ventilation systems are also air sealed to promote top performance.

None of the above inventions and patents, taken either singly or in combination, are seen to describe the instant invention as claimed. Thus a ventilated toilet system solving the aforementioned problems is desired.

SUMMARY OF THE INVENTION

The invention is a ventilated toilet system for a toilet bowl with a toilet rim and a perimeter that has a plurality of rim holes around the perimeter, which is fluidly connected to a flush passage. The toilet system also has a toilet tank with a flush lever, a trip lever and an overflow float valve that sits on top of an overflow tube and is biased downward by a weight, the overflow tube being connected to a flush tube that fluidly connects into the flush passage of the toilet bowl, a flapper that is removably set over the flush tube, that is connected by the trip lever and is activated by the flush lever, a fill valve, being filled with water provided from a water inlet and a second refill tube that is connected to the overflow tube. There is also a vacuum system motor to expel odors from the ventilated toilet system via odor exhaust piping of varying widths and an exhaust piping outlet, with an impeller and a housing, a flush lever button switch, a time delay contact relay, a ground fault circuit interrupter with an on/off switch and a contact relay.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
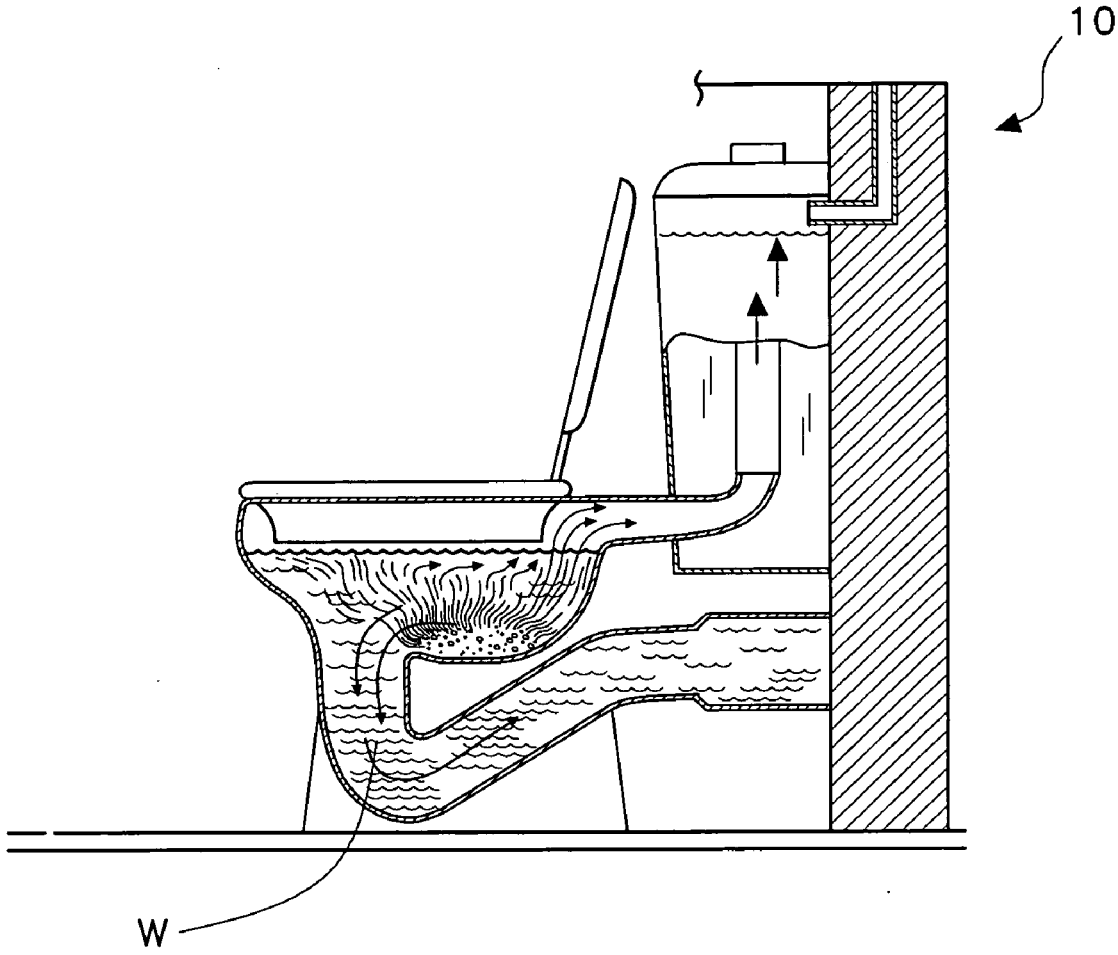
FIG. 1 is an environmental, perspective view of a ventilated toilet system according to the present invention.

The present invention is a ventilated toilet system 10, used by a person who is going to the bathroom and is generating disposable waste W, which is depicted in FIG. 1. The ventilated toilet system 10 comprises a toilet bowl 20 (FIG. 2), a toilet tank 30 (FIGS. 3A, 3B), a ventilation system 50 (FIGS. 4) and electrical systems 60,70 (FIGS. 5A, 5B, 6A, 6B), all of which are integral to each other to form the ventilated toilet system 10.

Figure 2:
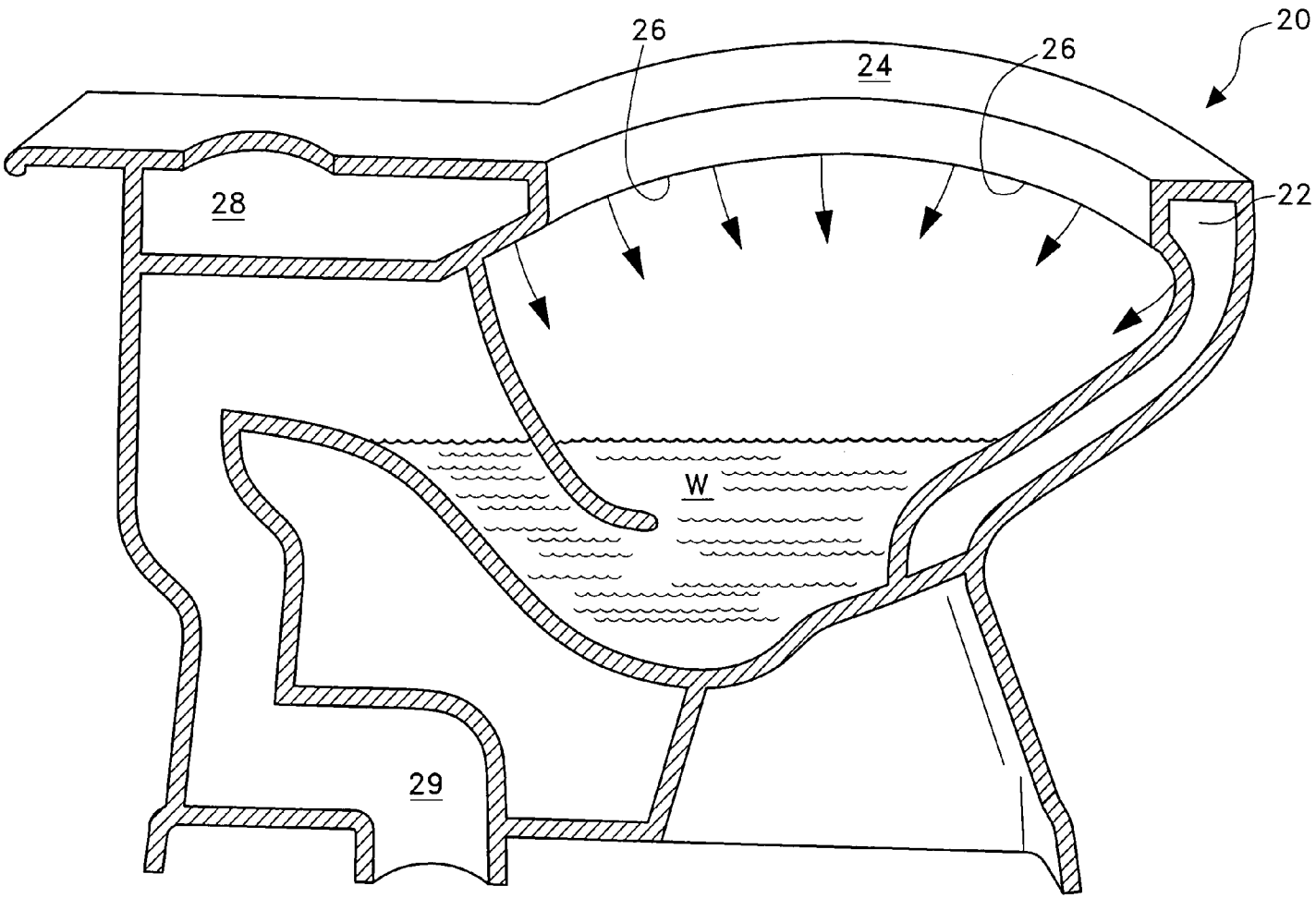
FIG. 2 is a top side perspective view of a toilet bowl.

The toilet bowl 20 depicted in FIG. 2, is not a novel feature of the ventilated toilet system 10 and is similar to other toilet bowls 20 that are described in the related art (e.g., U.S. Pat. No. 3,192,539 issued to Martz). The toilet bowl 20 has a toilet rim 22 and an inner perimeter 24 that has a plurality of rim holes 26 around the inner perimeter 24 which are fluidly connected to a flush passage 28 and other parts of the ventilated toilet system 10. The disposable waste W generated by a person is flushed from the toilet bowl 20 through a waste outlet 29 and into a sewer line (not shown).

Figure 3A:
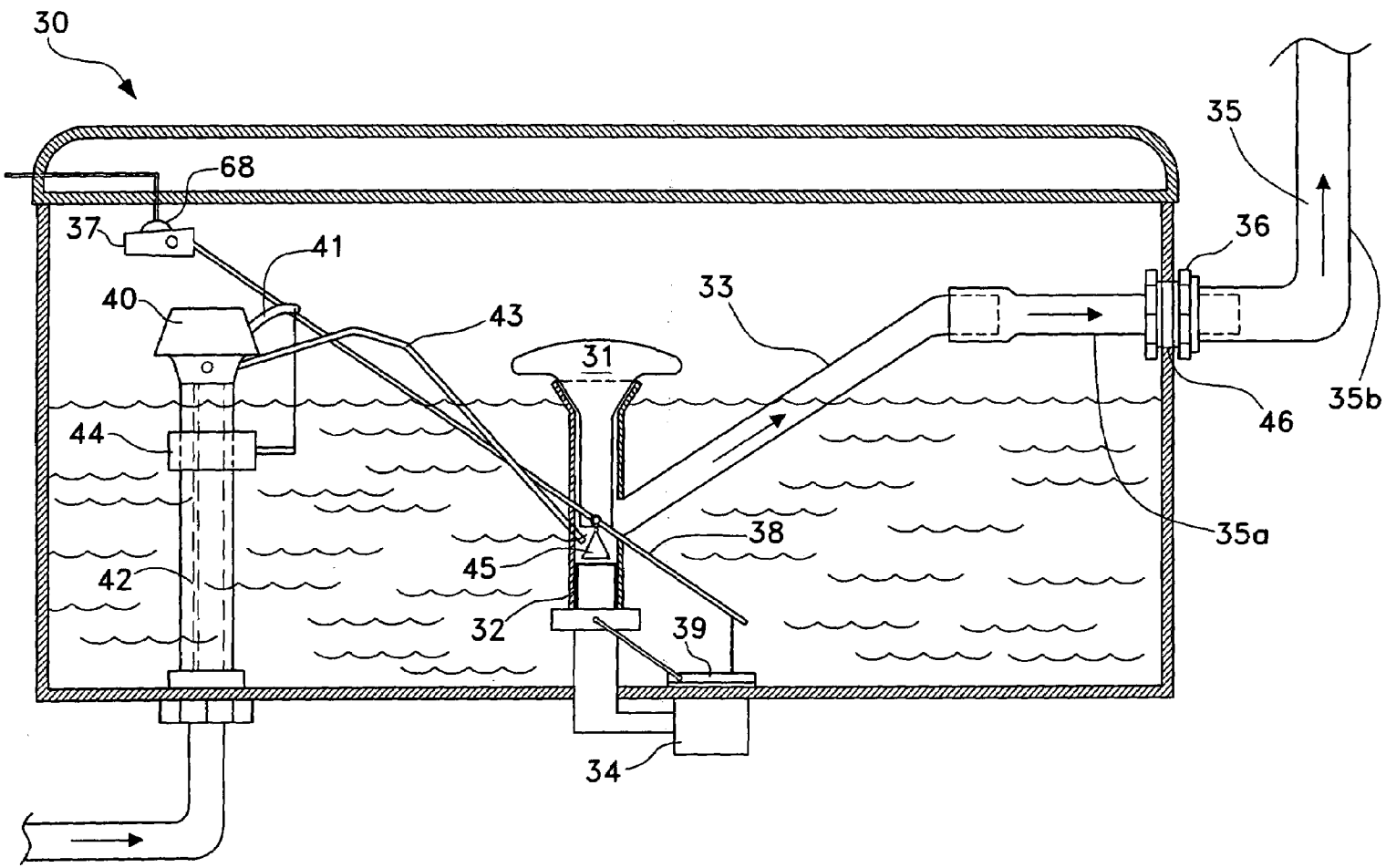
FIGS. 3A and 3B are front perspective views of toilet tanks for the first and second embodiments of the ventilated toilet system.
Figure 4:
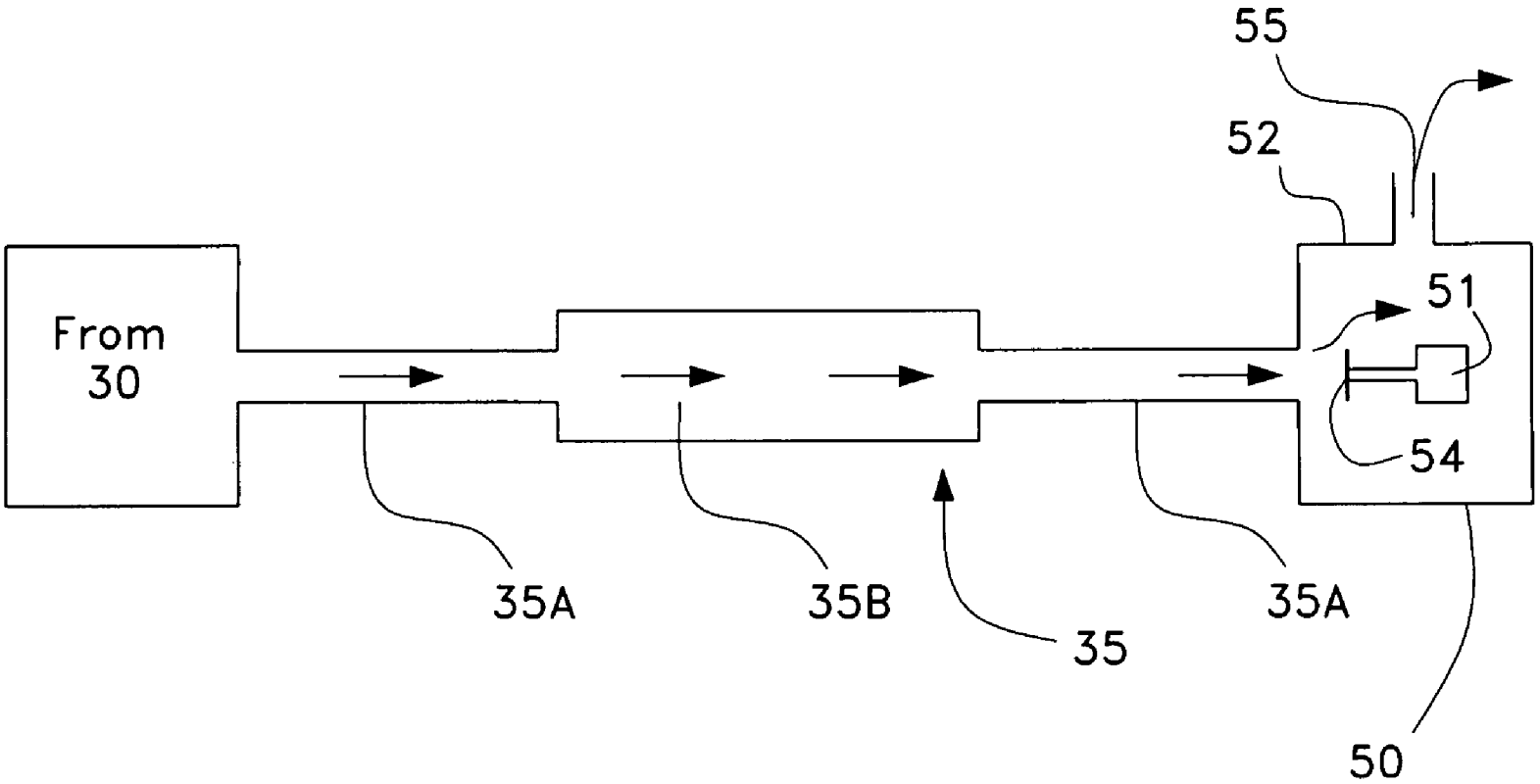
FIG. 4 is a side perspective view of ventilation systems for the first and second embodiments of the ventilated toilet system.

FIG. 3A depicts the first embodiment of the ventilated toilet system 10. This includes a toilet tank 30 that has an overflow float valve 31 that sits on top of an overflow tube 32, with an overflow tube fitting 33 fitted onto the overflow tube 32, which is connected to a flush tube 34 that fluidly connects into the flush passage 28 of the toilet bowl 20. The overflow tube fitting 33 is also attached and fluidly connected to an odor exhaust pipe 35, which leads to the ventilation system 50 (FIG. 4). A water seal grommet 36 seals the overflow tube fitting 33 over the outer perimeter to the toilet tank 30 as it penetrates through the side wall hole 46 of the toilet tank 30.

Normally the toilet tank 30 is filled to an adjusted water level. When the flush lever 37 is depressed after a person generates waste, it lifts a trip lever 38, which lifts a flapper 39 upward and opens a passage for water to flow into the flush tube 34. Water passes through the flush tube 34, through the flush passage 28, into the toilet rim 22 and finally fills the toilet bowl 20 with water through the plurality of rim holes 26. When water builds up in the toilet bowl 20, a siphoning action takes place and the water and all of the waste is discharged into the sewer line (not shown) through the waste outlet 29.

When the water level falls to a certain level, the float 44 that falls with the water level opens up the water fill valve 40 through the float arm 41 and water fills the toilet tank 30 through a first refill tube 42 and a second refill tube 43. The float 44 rises with the water and at the adjusted height, the float arm 41 shuts the water fill valve 40 and water stops filling the toilet tank 30.

In case of failure of the fill valve 40, water would fill the toilet tank 30 and could cause the toilet tank 30 to overflow. The overflow float valve 31 is to prevent this from happening. When water reaches the top of the overflow tube 32, it would lift up the overflow float valve 31 and water would flow down through the overflow tube 32. Since the overflow tube 32 is connected to the flush tube 34, water is drained into the toilet bowl 30.

The overflow float valve 31 is weighted down with a small weight 45 that acts as a guide to keep the overflow float valve 31 from drifting away when the overflow float valve 31 is lifted up by the water level, and brings it down to be seated back on the overflow tube 32. The overflow tube fitting 33 is connected to the odor exhaust pipe 35, which passes out through a hole 46 on the side of the wall of the toilet tank 30. The odor exhaust pipe 35 outer perimeter is also sealed water tight with a water seal grommet 36. The odor exhaust pipe 35 has small diameter ½" piping 35A that is used to speed-up the flow of air, thus generating additional suction power in the toilet bowl 20. This is complimented with larger diameter 2" piping 35B to drop pressure and slow down the speed of the air entering the pipe. By this action, any water particles sucked in would accumulate on the wall of the larger diameter 2" piping 35B, preventing them from entering the ventilation system 50. The larger diameter 2" piping 35B is then reduced to smaller diameter ½" piping 35A as it approaches the ventilation system 50. The larger diameter 2" piping 35B and the smaller diameter ½" piping 35A are depicted in FIG. 4. Also an activation button switch 68 on the flush lever 37 is provided in the first embodiment and is tied into the trip lever 38 and the electrical system 60 depicted in FIG. 5A and FIG. 5B.

Figure 3B:
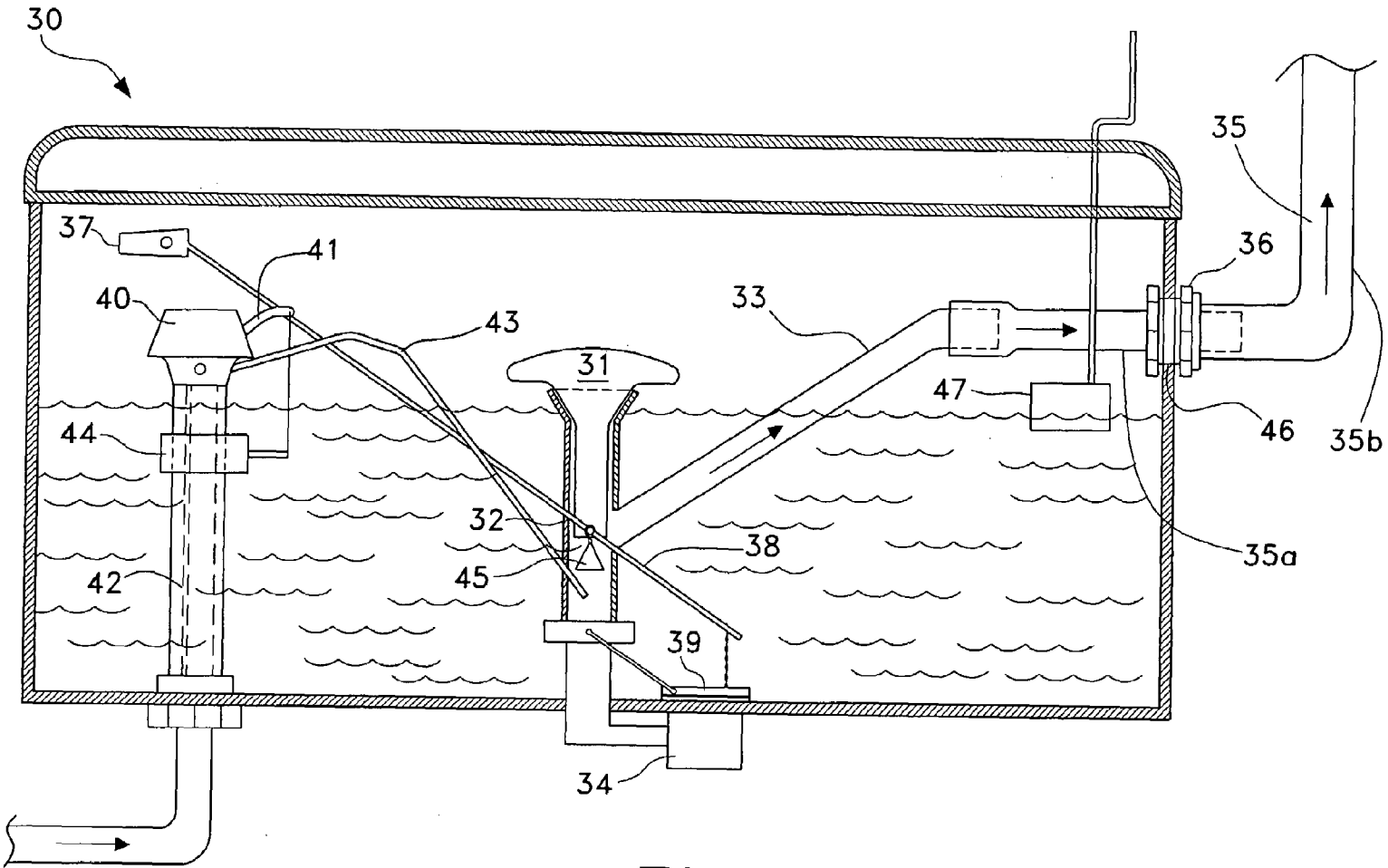

FIG. 3B depicts the second embodiment of the ventilated toilet system 10. Like the first embodiment, the toilet tank 30 has an overflow float valve 31 that sits on top of an overflow tube 32, with an overflow tube fitting 33 fitted onto the overflow tube 32, which is connected to a flush tube 34 that fluidly connects into the flush passage 28 of the toilet bowl 20. The overflow tube fitting 33 is also attached and fluidly connected to an odor exhaust pipe 35, which leads to the ventilation system 50 (FIG. 4). A water seal grommet 36 seals the overflow tube fitting 33 outer perimeter to the toilet tank 30 as it penetrates through the side wall hole 46 of the toilet tank 30.

Normally the toilet tank 30 is filled to an adjusted water level. When the flush lever 37 is depressed after a person generates waste, it lifts a trip lever 38, which lifts a flapper 39 upward and opens a passage for water to flow into the flush tube 34. Water passes through the flush tube 34, through the flush passage 28, into the toilet rim 22 and finally fills the toilet bowl 20 with water through the plurality of rim holes 26. When water builds up in the toilet bowl 20, a siphoning action takes place and the water and all of the waste is discharged into the sewer line (not shown) through the waste outlet 29.

When the water level falls to a certain level, the float that falls with the water level 44 opens up the water fill valve 40 through the float arm 41 and water fills the toilet tank 30 through a first refill tube 42 and a second refill tube 43. The float 44 rises with the water and at the adjusted height, the float arm 41 shuts the water fill valve 40 and water stops filling the toilet tank 30.

Like the first embodiment, in case of failure of the fill valve 40, water would fill the toilet tank 30 and could cause the toilet tank 30 to overflow. The overflow float valve 31 is to prevent this from happening. When water reaches the top of the overflow tube 32, the water lifts up the overflow float valve 31 and water flows down through the overflow tube 32. Since the overflow tube 32 is connected to the flush tube 34, water is then drained into the toilet bowl 20.

The overflow float valve 31 is weighted down with a small weight 45 that acts as a guide to keep the overflow float valve 31 from drifting away when the overflow float valve 31 is lifted up by the water level, and is brought down to be seated back on the overflow tube 32. The overflow tube fitting 33 is connected to the odor exhaust pipe 35, which passes out through a hole 46 on the side of the wall of the toilet tank 30.

The odor exhaust pipe 35 outer perimeter is also sealed water tight with a water seal grommet 36. The odor exhaust pipe 35 has a small diameter ½" piping 35A that is used to speed-up the flow of air, thus generating additional suction power in the toilet bowl 20. This is complimented with larger diameter 2" piping 35B to drop pressure and slow down the speed of the air entering the odor exhaust pipe 35. By this action, any water particles sucked in would accumulate on the wall of the larger diameter 2" piping 35B, preventing the water from entering the ventilation system 50. The larger diameter 2" piping 35B is then reduced to smaller diameter ½" piping 35A as it approaches the ventilation system 50. The larger diameter 2" piping 35B and the smaller diameter ½" piping 35A are depicted in FIG. 4. Also a float switch 47 is provided in the second embodiment and is tied into the electrical system 70 depicted on FIG. 6A and FIG. 6B.

FIG. 4 depicts the next part of the ventilation toilet system 10, which is a ventilation system 50 to expel odors from the ventilated toilet system 10. The ventilation system 50 is equipped with a vacuum system motor 51, a housing 52, an impeller 54 and an outlet vent 55. The odor exhaust pipe 35 is attached to the housing 52. The outlet vent 55 is penetrated through the wall or ceiling of the bathroom and the electrical systems 60 and 70 are tied into the vacuum system motor 51 when the ventilation system 50 has been activated.

Upon activation of the ventilation system 50, the vacuum system motor 51 is activated and the impeller 54 sucks in air from the toilet bowl 20. As odor is generated in the toilet bowl 20, it is sucked in through the plurality of rim holes 26 into the toilet rim 22 and then through the flush passage 28. The air is then sucked in through the flush tube 34, through the overflow tube 32 and then passes on into the overflow tube fitting 33. The air is then sucked through the odor exhaust pipe 35 and into the housing 52 and finally through the outlet vent 55. When the vacuum system motor 51 is activated, the overflow float valve 31 is also sucked in, therefore sealing the flared portion of the overflow tube 32. This allows the vacuum system motor 51 to suck up foul air only from the toilet bowl 20.

During normal operation, the overflow float valve 31 has the top portion of the overflow tube 32 closed. Air from the toilet bowl 20 is sucked in and passes through the outlet vent 55. When the flush lever 37 is depressed and water flushes the toilet bowl 20, the flush tube 34 and the toilet rim 22 become filled with water, causing water to be sucked into the overflow tube fitting 33, and if not prevented, would eventually reach the ventilation system housing 52, which is not a desirable thing to happen. This is illustrated in FIG. 4, which illustrates the ventilation system 50 used for both the first and second embodiments of the ventilated toilet system 10.

Figure 5A:
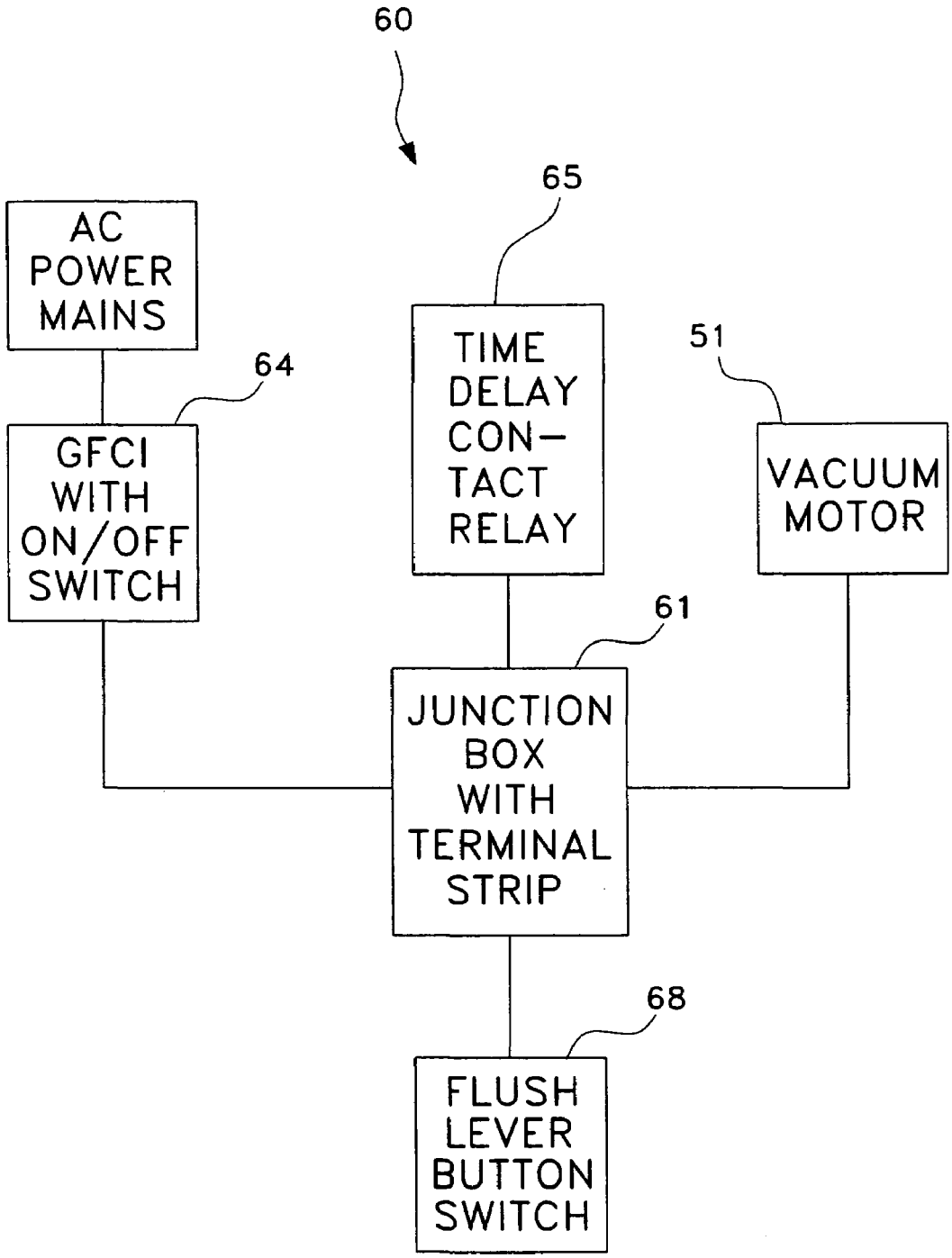
FIGS. 5A and 5B depict electrical diagrams of the first embodiment of the ventilated toilet system.
Figure 5B:
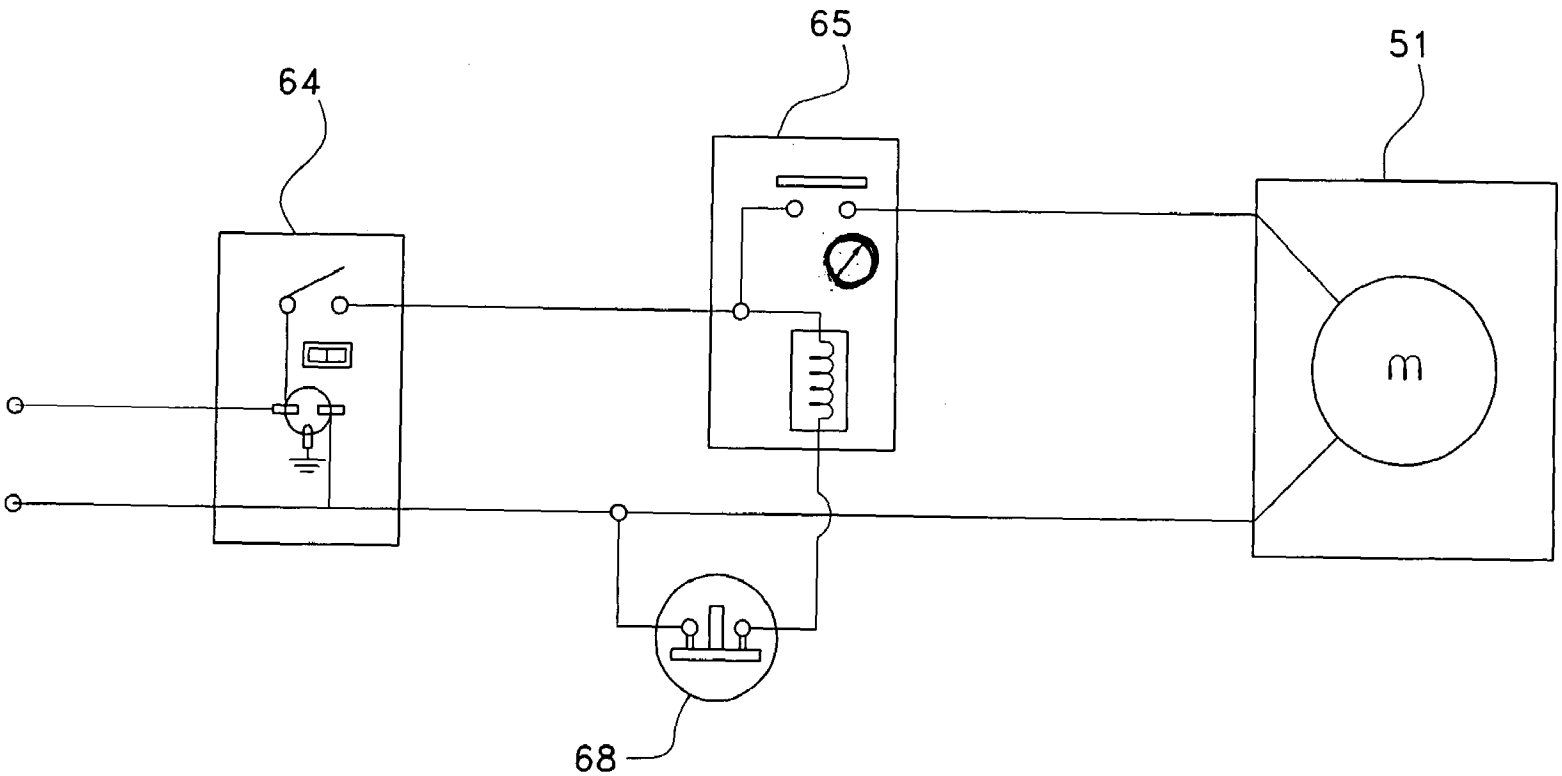

FIGS. 5A and 5B illustrate the electrical system of the first embodiment 60 of the ventilated toilet system 10. The electrical system of the first embodiment 60 includes an activation button switch 68 seated on the flush lever 37, a time delay contact relay 65, a junction box 61 and a ground fault circuit interrupter 64 with an on/off switch and a vacuum system motor 51. Electrical wiring is provided from the activation button switch 68 on the flush lever 37 to the junction box 61, from the ground fault circuit interrupter 64 with an on/off switch to the junction box 61, from the junction box 61 to the time delay contact relay 65 and from the junction box 61 to the vacuum system motor 51. All of the components described in the electrical system of the first embodiment 60 of the ventilated toilet system 10 are well-known to those that are schooled in the related art.

Figure 6A:
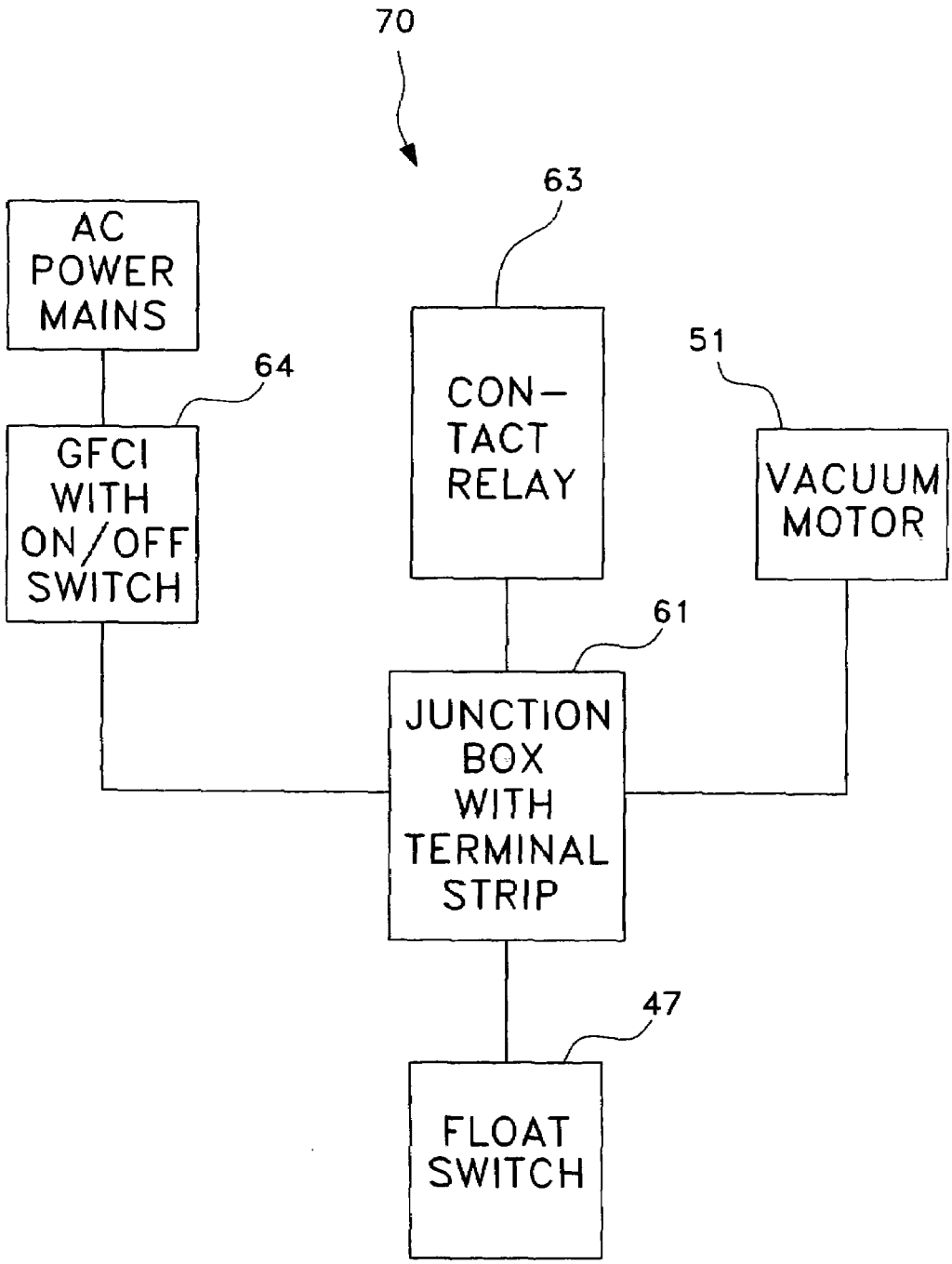
FIGS. 6A and 6B depict electrical diagrams of the second embodiment of the ventilated toilet system.
Figure 6B:
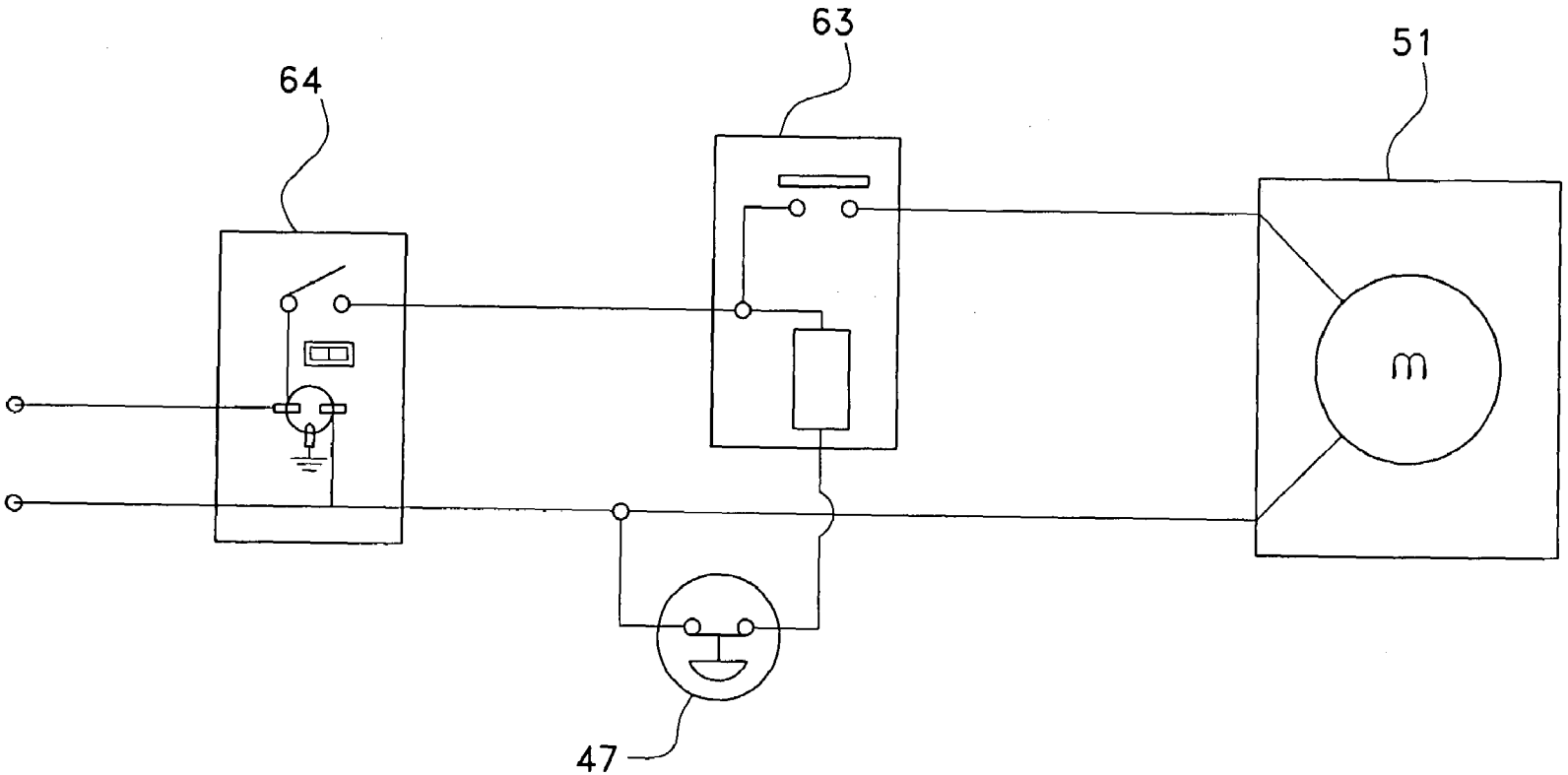

FIGS. 6A and 6B illustrate the electrical system 70 that is tied into the second embodiment of the ventilated toilet system 10. The electrical system 70 includes a ground fault circuit interrupter 64 with an on/off switch, a float switch 47 (described in FIG. 3B), a junction box 61, a contact relay 63 and a vacuum system motor 51. Electrical wiring is provided from the float switch 47 to the junction box 61, from the ground fault circuit interrupter 64 and to the junction box 61, from the contact relay 63 and to the junction box 61 and from the vacuum system motor 51 and to the junction box 61. All of the components described in the electrical system of the second embodiment 70 of the ventilated toilet system 10 are well-known to those that are schooled in the related art.

As shown in FIGS. 5A, 5B, the functioning of the first embodiment of the electrical system 60 begins when the GFCI switch 64 is switched on and power is supplied to the vacuum system motor 51 through the time delay contact relay 65, which is energized through the activation button switch 68. The vacuum system motor 51 sucks up air from the toilet bowl 20 and is exhausted through the exhaust outlet 55 as previously explained. When the flush lever 37 is depressed, the activation button switch 68 is also pressed together with the flush lever 37. Pressing the activation button switch 68 cuts the power to the time delay contact relay 65, which is set to a certain delay time. The time delay contact relay 65 remains de-energized to the delay time set even though the activation button switch 68 is released and electric contact has been restored to the time delay contact relay 65. When the time delay contact relay 65 is de-energized, the vacuum system motor 51 becomes de-energized and no air is sucked up through the overflow tube fitting 33. This action prevents water that is filled in the flush tube 34 and flush passage 28 to be sucked up into the ventilation system 50 when the flush lever 37 is used. After the preset delay time is reached, the time delay contact relay 65 is re-energized through the activation button switch 68 and power is restored through its contact to the vacuum system motor 51. The vacuum system motor 51 sucks up air again from the toilet bowl 20 until the GFCI switch 64 is turned off. During this time, the toilet bowl 20 has been flushed and the toilet tank 30 has been filled with water and the entire ventilated toilet system 10 is ready for another operation.

As shown in FIGS. 6A, 6B, the functioning of the second embodiment of the electrical system 70 begins when the GFCI switch 64 is switched on and power is supplied to the vacuum system motor 51 through the contact relay 63, which is energized through the float switch 47. The vacuum system motor 51 sucks up air from the toilet bowl 20 and expels the air through the outlet vent 55. When the flush lever 37 is depressed, the water level in the toilet tank 30 falls. A very small fall in water level will activate the float switch 47, which cuts off power to the contact relay 63, de-energizes the contact relay 63 and cuts power to the vacuum system motor 51, with no air being sucked up through the overflow tube fitting 33. This action prevents water that is filled in the flush tube 34 and flush passage 28 when the flush lever 37 is depressed, to be sucked up into the vacuum system motor 51. After the toilet bowl 20 has been flushed and the toilet tank 30 is refilled with water, the float switch 47 closes and the contact relay 63 is re-energized and power is restored through its contacts with the vacuum system motor 51 and air is sucked up once more from the toilet bowl 20, until the GFCI switch 64 is switched off. This prevents water from entering the vacuum system motor 51 while preserving the basic operation of the ventilated toilet system 10.

Components of the ventilated toilet system 10 can also be retrofit for an existing toilet bowl 20 and toilet tank 30 with a cut-to-length existing overflow tube 32, and an overflow tube fitting 33. These components comprise an overflow tube fitting 33 fitted onto the existing cut-to-length overflow tube 32, which is fluidly connected to the flush tube 34. The overflow tube fitting 33 is fluidly connected to an odor exhaust pipe 35. A water seal grommet 36 is used to seal the odor exhaust pipe 35 to the toilet tank 30 at hole 46. The retrofit further comprises a ventilation system 50 to expel odors from the ventilated toilet system 10, with a vacuum system motor 51, a housing 52, an impeller 54 and an outlet vent 55.

It is to be understood that the present invention is not limited to the embodiments described above, but encompasses any and all embodiments within the scope of the following claims.

I claim:

1. In combination, a toilet system and a ventilation system, said combination comprising:

a toilet bowl and toilet tank;

said toilet bowl including an upper perimeter rim having a plurality of holes predeterminedly spaced therearound, and a lower outlet;

said toilet tank designed and configured to hold a predetermined volume of water, said toilet tank having a flush lever and a flapper valve operatively coupled to selectively release the volume of water in said toilet tank into said toilet bowl, a water fill valve that opens to direct water through a first refill tube and a second refill tube for maintaining the volume of water in the toilet tank and the toilet bowl at a predetermined level, an overflow tube fitted with an overflow tube fitting, said overflow tube for directing water exceeding the predetermined level from the toilet tank into the toilet bowl, and an overflow float valve having a weight, said overflow float valve and weight for sealing said overflow tube;

wherein said overflow float valve and weight opens said overflow tube when the water exceeds the predetermined level, allowing the water to flow into the toilet bowl;

a ventilation system for directing odors in the toilet bowl into said holes around said upper perimeter, through said overflow tube and said overflow tube fitting, and out of said toilet tank;

said ventilation system including a vacuum motor and impeller, a ground fault circuit interrupter on/off switch for providing a supply of electrical power to said vacuum motor and impeller, an activation button switch seated on the flush lever and a time delay contact relay for deactivating the supply of electrical power for a predetermined period of time, said time delay contact relay being set to a certain delay time which corresponds to said predetermined period of time;

a small diameter pipe and a large diameter pipe forming an odor exhaust pipe;

said small diameter pipe being coupled at one end to said overflow tube fitting that is fitted to said overflow tube inside said toilet tank, said large diameter pipe extending from the other end of said small diameter pipe and being in fluid communication with said vacuum motor and impeller externally of said toilet tank; and said odor exhaust pipe passing out of said toilet tank through a hole in said toilet tank with a watertight grommet;

wherein when said ground fault circuit interrupter on/off switch activates said vacuum motor, said impeller draws odors from said toilet bowl, and when a user flushes the toilet by pressing the flush lever said activation button switch and time delay contact relay deactivates said vacuum motor for a predetermined period of time, and reactivates said vacuum motor after the predetermined period of time has elapsed, said predetermined period of time corresponding to the time which elapses from the pressing of the flush lever until the toilet tank refills with water, and wherein said ventilation system may be completely turned off, at the discretion of the user, by turning off said ground fault circuit interrupter on/off switch.

2. In combination, a toilet system and a ventilation system, said combination comprising:

a toilet bowl and toilet tank;

said toilet bowl including an upper perimeter rim having a plurality of holes predeterminedly spaced therearound, and a lower outlet; said toilet tank designed and configured to hold a predetermined volume of water, said toilet tank having a flush lever and a flapper valve operatively coupled to selectively release the volume of water in said toilet tank into said toilet bowl, a water fill valve that opens to direct water through a first refill tube and a second refill tube for maintaining the volume of water in the toilet tank and the toilet bowl at a predetermined level, an overflow tube fitted with an overflow tube fitting, said overflow tube for directing water exceeding the predetermined level from the toilet tank into the toilet bowl, and an overflow float valve having a weight, said overflow float valve and weight for sealing said overflow tube;

wherein said overflow float valve and weight opens said overflow tube when the water exceeds the predetermined level, allowing the water to flow into the toilet bowl;

a ventilation system for directing odors in the toilet bowl into said holes around said upper perimeter, through said overflow tube and said overflow tube fitting, and out of said toilet tank;

said ventilation system including a vacuum motor and impeller, a ground fault circuit interrupter on/off switch for providing a supply of electrical power to said vacuum motor and impeller, a contact relay electrically connected to supply electrical power from said ground fault circuit interrupter on/off switch to said vacuum motor, and a float switch for automatically deactivating and reactivating the supply of electrical power in response to the water level within the toilet tank, said float switch electrically connected to said contact relay and located within the toilet tank;

a small diameter pipe and a large diameter pipe forming an odor exhaust pipe;

said small diameter pipe being coupled at one end to said overflow tube fitting that is fitted to said overflow tube inside said toilet tank, said large diameter pipe extending from the other end of said small diameter pipe and being in fluid communication with said vacuum motor and impeller externally of said toilet tank; and said odor exhaust pipe passing out of said toilet tank through a hole in said toilet tank with a watertight grommet;

wherein when said ground fault circuit interrupter on/off switch activates said vacuum motor said impeller draws odors from said toilet bowl, and when a user flushes the toilet by pressing the flush lever said float switch opens in response to the falling water level in said toilet tank, whereby said contact relay de-energizes and deactivates said vacuum motor;

wherein when the toilet flush cycle has completed and said toilet tank has refilled with water said float switch closes in response to the water level in said toilet tank and said contact relay re-energizes and reactivates said vacuum motor; and wherein said ventilation system may be completely turned off, at the discretion of the user, by turning off said ground fault circuit interrupter on/off switch.

* * * * *